United States Patent [19]

Bonin

[11] Patent Number: 4,886,047

[45] Date of Patent: Dec. 12, 1989

[54] FIREPLACE HEAT EFFICIENCY DEVICE

[76] Inventor: Paul R. Bonin, P.O. Box 53122, Lafayette, La. 70505

[21] Appl. No.: 254,611

[22] Filed: Oct. 7, 1988

[51] Int. Cl.[4] ..... F24B 1/195

[52] U.S. Cl. ..... 126/552; 126/500/83

[58] Field of Search ..... 126/552, 553, 500, 505, 126/506, 528, 83

[56] References Cited

U.S. PATENT DOCUMENTS

| | | | |
|---|---|---|---|
| 267,885 | 11/1882 | Harding | 126/552 |
| 1,128,358 | 2/1915 | Peake | 126/552 |
| 2,131,763 | 10/1938 | Sroat | 126/552 |
| 2,396,535 | 3/1946 | Rumery | 126/552 |
| 3,213,846 | 10/1965 | Rodgers et al. | 126/552 |
| 4,194,490 | 3/1980 | Crnkovic | 126/553 |
| 4,526,159 | 7/1985 | Vroome | 126/552 |
| 4,574,774 | 3/1986 | Wells | 126/552 |

*Primary Examiner*—Ira S. Lazarus
*Assistant Examiner*—Christopher Hayes

[57] ABSTRACT

A simple, low-cost, low-maintenance device to be added or built in to a fireplace, which, by convective and radiative means, increases the amount of heat transferred to living areas, is architecturally unobstrusive in design and silent in function.

9 Claims, 3 Drawing Sheets

FIREPLACE HEAT EFFICIENCY DEVICE

BACKGROUND OF THE INVENTION

There are devices presently available which use water or other fluids to transfer heat from the fireplace interior to living areas, but these increase greatly the maintenance requirements of the fireplace. Some devices use multiple panels which require hinges, grooved frames, chains, and other unsightly attachments which clutter the appearance of the fireplace interior and also create maintenance problems. Some devices may rely on exotic, highly polished materials for reflection of heat, creating the possibility of constant cleaning being necessary for proper function, or expensive replacement in case of damage. Prior art provides many examples of fireplace devices, but they seem to be expensive, unsightly, complicated in design or hard to upkeep, as evidenced by the fact that none has been generally accepted as an industry-wide "standard" in the fireplace industry. The huge number of fireplaces already present in homes, apartments, etc. has created a need for a low-cost, low-maintenance device which increases fireplace heat production, does not detract from the esthetic appeal of an open fire, and is easily installed. The fireplace heat efficiency device presented in this petition for your consideration meets these needs.

SUMMARY OF THE INVENTION

This fireplace heat efficiency device consists of a vertical reflector component, a horizontal component, a transition area between the vertical and horizontal components, a shield component and legs or attachment points. Legs may be designed to set on or attach to the firebox floor or fuel grate. Legs or spacers may be used as attachment points for shield component. Shield component functions to provide a passageway of substantially unobstructed space in front of the vertical component to allow convective flow of air/wood gas mixture to flow upward to the horizontal component. Legs or attachment points may be adjustable to provide for different firebox opening heights, the object being to elevate the horizontal component as high as possible so that it is not easily noticed once installed. The device may also be built in to new construction of fireplaces, using the fireplace wall as the vertical reflector component. The simple construction of this device allows use of high quality materials to be utilized at low cost. The inventor paid less the $20.00 at a local sheet metal shop for enough stainless steel to build a model during testing. Use of this type of material provides maintenance-free operation for long periods of time.

DESCRIPTION OF THE PREFERRED EMBODIMENTS

Figure 1:
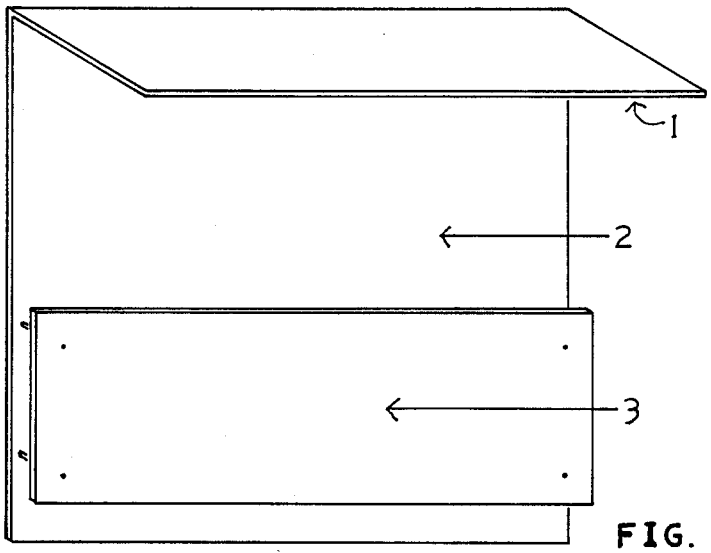
FIG. 1 is a perspective view of the fireplace heat efficiency device.

FIG. 1 shows the fireplace heat efficiency device in a perspective view with no support or attachment means.

Figure 2:
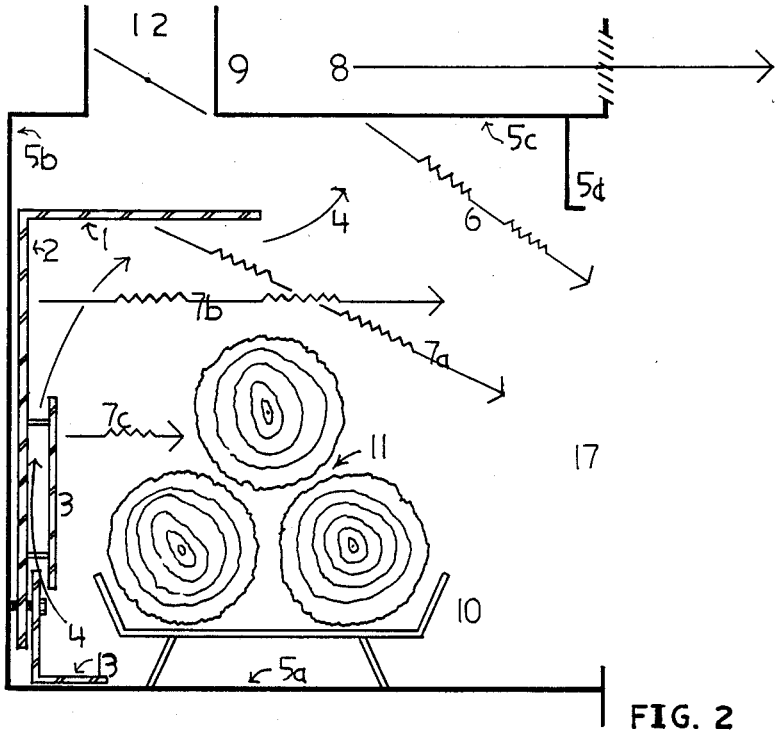
FIG. 2 is a cross section view of the preferred embodiment of the invention.

FIG. 2 shows the preferred embodiment of the device installed in a fireplace 5*a*,5*b*, and 5*c*; having a firebox floor 5*a*, a rear wall 5*b*, an upper surface 5*c*, a fuel grate 10, a heat source 11, a chimney 12, an opening 17 with an upper boundary 5*d*. The invention comprises a substantially horizontal surface 1, positioned at the approximate height of the lower edge of the upper boundary 5*d*, a substantially vertical surface paralleling the rear wall 5*b* or touching it if possible, a shield 3 attached to the substantially vertical surface 2 and parallel to the vertical surface 2. This configuration forms a passageway for a convective flow of air and wood gases 4 upwardly to the horizontal surface 1. This convective flow ignites and produces additional useful heat. The horizontal surface 1 deflects the convective flow of hot air and burning wood gases away from the chimney 12 and onto the upper surface 5*c*, thereby raising the temperature of the upper surface 5*c*, and causing additional heat 6 to be radiated from this surface 5*c*. Horizontal surface 1 also radiates heat 7*a* through fireplace opening 17. The vertical surface 2 radiates additional heat 7*b*; shield 3, which is directly exposed to heat source 11, also radiates heat 7*c*. In the case of pre-fabricated steel fireplaces which have an air chamber 9 above the upper surface 5*c*, this air chamber receives heat from the horizontal surface 1, thus increasing the heat 8 transferred outside the fireplace via this chamber 9. The device is supported in FIG. 1 by legs 13 attached to device at one end of the legs, and resting on fireplace floor 5*a* on the other end of the legs. Two such legs have been sufficient for each device built thus far, but extra legs could be provided if needed.

Figure 3:
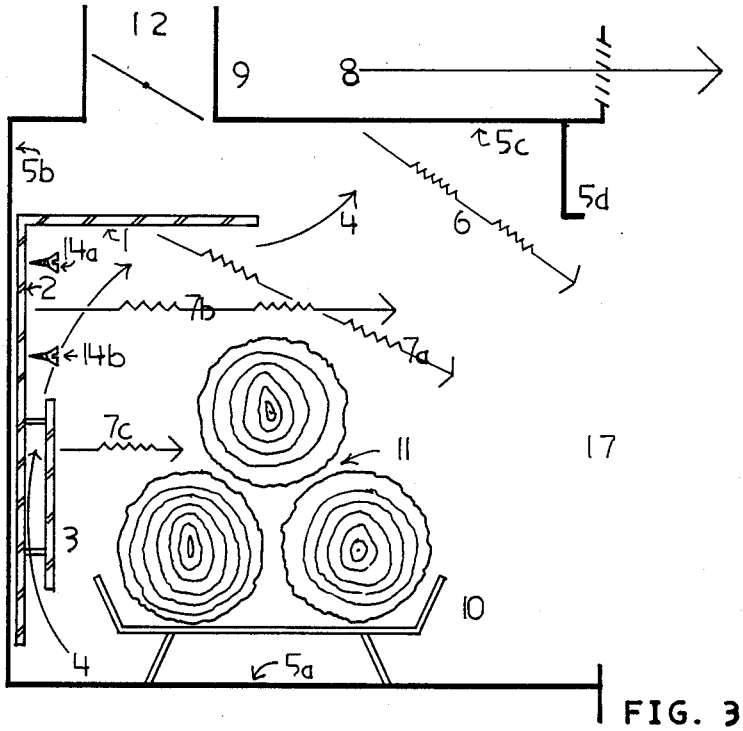
FIG. 3 is a cross section view of the invention illustrating attachment to wall of fireplace.

FIG. 3 shows the invention attached to the fireplace wall 5*b* by attachments 14*a* and 14*b*. Screws are shown for illustration, but other means of attachment could certainly be provided.

Figure 4:
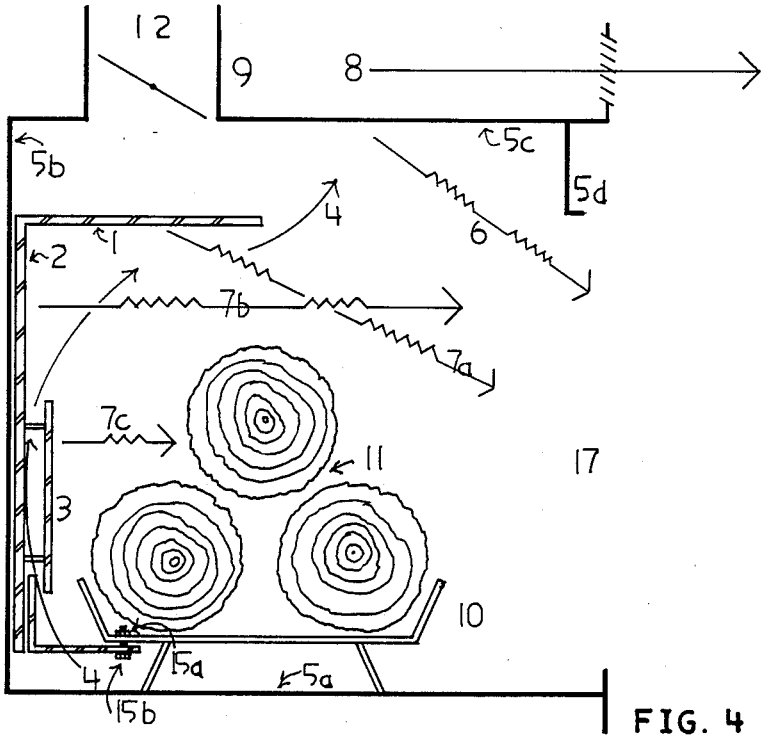
FIG. 4 shows invention attached to fuel grate.

FIG. 4 shows the device attached to the fuel grate 10 by attachments 15*a* and 15*b*. Nut and bolt attachment is shown, but other means of attachment could work as well.

Figure 5:
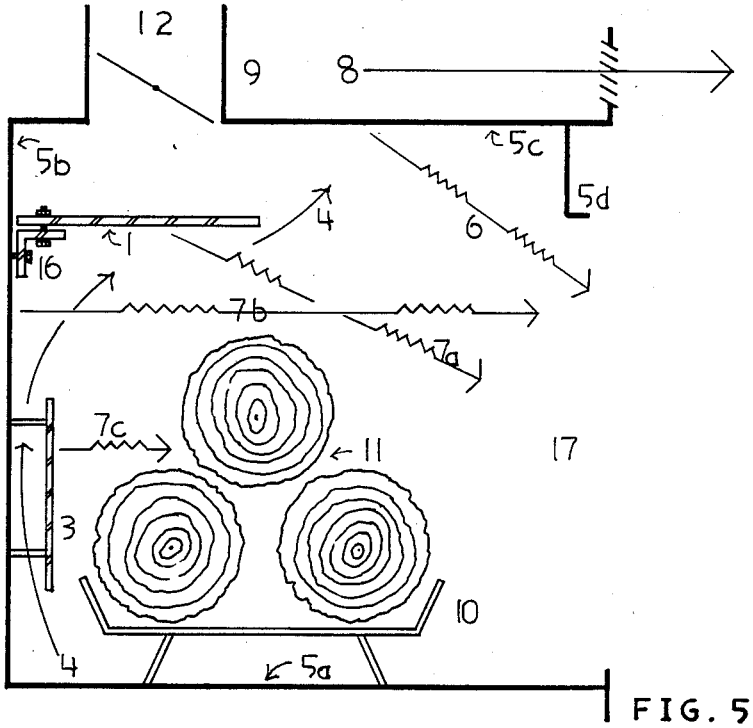
FIG. 5 illustrates the device built in to a fireplace.

FIG. 5 is an illustration of the device as an integral part of a fireplace, whereby the fireplace rear wall 5*b* is built of an appropriate type of material, such as stainless steel, and serves as rear wall 5*b* and vertical surface 2, providing the same functions as rear wall 5*b* and vertical surface 2 in FIG. 1. Horizontal surface 1 attaches to vertical surface 5*b*, using brackets 16 in this illustration; however other means of attachments could be used. The shield 3 is attached to rear wall 5*b*, as in FIG. 1, in such a manner as to provide a passageway for hot air and burning wood gases to rise upwardly.

I claim:

1. A fireplace heat efficiency device for use in a fireplace having a firebox floor, a fuel grate, a heat source, and a rear wall, said device comprising:

a substantially vertical surface, said substantially vertical surface being substantially parallel to said rear wall;

a shield attached to said substantially vertical surface, said shield being substantially parallel to said substantially vertical surface;

a passageway between said substantially vertical surface and said shield, said passageway providing substantially unobstructed flow of air upwardly between said shield and said substantially vertical surface;

and a substantially horizontal surface supportively attached to said substantially vertical surface by attachment means, said substantially horizontal surface supported above said shield and said firebox floor by said substantially vertical surface, said substantially horizontal surface being directly exposed to said heat source.

2. The device of claim 1, wherein said substantially vertical surface is supported by support means attached to said rear wall.

3. The device of claim 1, wherein said substantially vertical surface is supported by support means attached to said fuel grate.

4. The device of claim 1, wherein said substantially vertical surface is supported by legs which support it above said firebox floor.

5. A fireplace heat efficiency device for use in a fireplace having a firebox floor, a fuel grate, a heat source, and rear wall, said device comprising:

a single imperforate sheet of material including a substantially vertical surface, a substantially horizontal surface, and a bent section between said substantially vertical surface and said substantially horizontal surface;

a substantially vertical shield attached to said substantially vertical surface of said single sheet of material, and a passageway between said shield and said substantially vertical surface, said passageway providing substantially unobstructed flow of air upwardly between said shield and said substantially vertical surface, wherein said substantially horizontal surface is directly exposed to said heat source.

6. The device of claim 5, wherein said substantially vertical surface is supported by support means attached to said rear wall.

7. The device of claim 5, wherein said substantially vertical surface is supported by support means attached to said fuel grate.

8. The device of claim 5, wherein said substantially vertical surface is supported by legs which support it above said firebox floor.

9. A fireplace heat efficiency device for use in a fireplace having a firebox floor, a fuel grate, a heat source, and rear wall, said device comprising:

a shield attached to said rear wall, said shield being substantially parallel to said rear wall;

a passageway between said rear wall and said shield, said passageway providing substantially unobstructed flow of air upwardly between said rear wall and said shield;

and a substantially horizontal surface supportively attached to said rear wall by attachment means, said substantially horizontal surface supported above said shield and said firebox floor by said rear wall, said substantially horizontal surface being directly exposed to said heat source.

* * * * *